US010852677B2

(12) United States Patent
Sato et al.

(10) Patent No.: US 10,852,677 B2
(45) Date of Patent: Dec. 1, 2020

(54) FILM USED FOR FIXING DEVICE AND FIXING DEVICE INCLUDING THE FILM

(71) Applicant: CANON KABUSHIKI KAISHA, Tokyo (JP)

(72) Inventors: Yutaka Sato, Komae (JP); Takashi Narahara, Mishima (JP); Takeshi Shinji, Yokohama (JP); Kazuhiro Doda, Yokohama (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/201,875

(22) Filed: Nov. 27, 2018

(65) Prior Publication Data

US 2019/0094772 A1 Mar. 28, 2019

Related U.S. Application Data

(63) Continuation of application No. PCT/JP2017/019556, filed on May 25, 2017.

(30) Foreign Application Priority Data

May 31, 2016 (JP) ..... 2016-109285

(51) Int. Cl.
*G03G 15/20* (2006.01)

(52) U.S. Cl.
CPC ..... *G03G 15/2057* (2013.01); *G03G 15/2042* (2013.01); *G03G 15/2053* (2013.01)

(58) Field of Classification Search
CPC ..... G03G 15/2053; G03G 2215/2035; G03G 15/2042; G03G 15/2017; G03G 15/2039
See application file for complete search history.

(56) References Cited

U.S. PATENT DOCUMENTS

2012/0308278 A1* 12/2012 Kikuchi ..... G03G 15/205 399/329
2014/0318931 A1* 10/2014 Takematsu ..... B65G 15/60 198/837

FOREIGN PATENT DOCUMENTS

| | | | |
|---|---|---|---|
| JP | 6-110348 | A | 4/1994 |
| JP | 9-319246 | A | 12/1997 |
| JP | 2011-253141 | A | 12/2011 |
| JP | 2012-53456 | A | 3/2012 |
| JP | 2013-186365 | A | 9/2013 |

(Continued)

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A fixing member used for a fixing device includes a tubular base layer; an electrode portion formed on the base layer; a heat generating portion formed on the base layer in such a manner as to be positioned next to the electrode portion in a longitudinal direction of the fixing member, the heat generating portion being electrically connected to the electrode portion; and an overcoat layer formed on the heat generating portion. The heat generating portion is a layer formed by a plurality of thin linear layers extending in the longitudinal direction of the fixing member and spaced from one another along a circumferential direction of the fixing member. The overcoat layer extends over a boundary between the heat generating portion and the electrode portion in the longitudinal direction of the fixing member.

16 Claims, 8 Drawing Sheets

(56) References Cited

FOREIGN PATENT DOCUMENTS

| | | | |
|---|---|---|---|
| JP | 2014232302 | A | 12/2014 |
| JP | 2015-152824 | A | 8/2015 |

* cited by examiner

FILM USED FOR FIXING DEVICE AND FIXING DEVICE INCLUDING THE FILM

CROSS-REFERENCE TO RELATED APPLICATIONS

This application is a Continuation of International Patent Application No. PCT/JP2017/019556, filed May 25, 2017, which claims the benefit of Japanese Patent Application No. 2016-109285, filed May 31, 2016, both of which are hereby incorporated by reference herein in their entirety.

TECHNICAL FIELD

The present invention relates to a film used in a fixing device mounted on an image forming apparatus, such as a printer or copier, and also relates to a fixing device including the film.

BACKGROUND ART

As a film used in a fixing device mounted on a copier or printer, one that includes electrode layers formed at both ends of the film in the longitudinal direction and a heating layer interposed between the electrode layers in such a manner as to be connected thereto is known (see, e.g., Japanese Patent Laid-Open No. 2011-253141). A fixing device including this film enables the film to generate heat by using Joule heat which is generated by bringing an electrode member, such as a conductive brush, into contact with each electrode layer so as to pass current through the heating layer. Using this film, which is capable of generating heat, can contribute to energy saving and reduced warm-up time for the fixing device.

With this configuration, however, mechanical stress produced in the film may damage the connecting portion between each electrode layer and the heating layer.

SUMMARY OF INVENTION

A first aspect of the present invention is a fixing member used for a fixing device. The fixing member includes a tubular base layer; an electrode portion formed on the base layer; a heat generating portion formed by a plurality of thin linear layers extending in a longitudinal direction of the fixing member and spaced from one another along a circumferential direction of the fixing member, the heat generating portion being formed on the base layer in such a manner as to be positioned next to the electrode portion in the longitudinal direction of the fixing member and electrically connected to the electrode portion; and an overcoat layer formed on the heat generating portion in such a manner as to extend over a boundary between the heat generating portion and the electrode portion in the longitudinal direction of the fixing member.

A second aspect of the present invention is a fixing device that fixes an image onto a recording material and includes a fixing member and a power supply member. The fixing member includes a tubular base layer; an electrode portion formed on the base layer; a heat generating portion formed by a plurality of thin linear layers extending in a longitudinal direction of the fixing member and spaced from one another along a circumferential direction of the fixing member, the heat generating portion being formed on the base layer in such a manner as to be positioned next to the electrode portion in the longitudinal direction of the fixing member and electrically connected to the electrode portion; and an overcoat layer formed on the heat generating portion in such a manner as to extend over a boundary between the heat generating portion and the electrode portion in the longitudinal direction of the fixing member. The fixing member is configured to come into contact with the image. The power supply member is configured to supply power through the electrode portion to the heat generating portion. The fixing member generates heat as current flows through the heat generating portion, and a toner image is fixed onto the recording material by the heat of the fixing member.

Further features of the present invention will become apparent from the following description of exemplary embodiments with reference to the attached drawings.

DESCRIPTION OF EMBODIMENTS

A film (fixing member) and a fixing device using the film will now be described in detail on the basis of embodiments. In the following description of a device configuration, the term "longitudinal direction" refers to the longitudinal direction of the film, the term "circumferential direction" refers to the circumferential direction of the film, and the term "thickness direction" refers to the thickness direction of the film.

First Embodiment

A first embodiment will be described with reference to FIGS. 1 to 5. In the present embodiment, a configuration of a fixing film is described first, and this is followed by a description of a fixing device including the fixing film.

Figure 1:
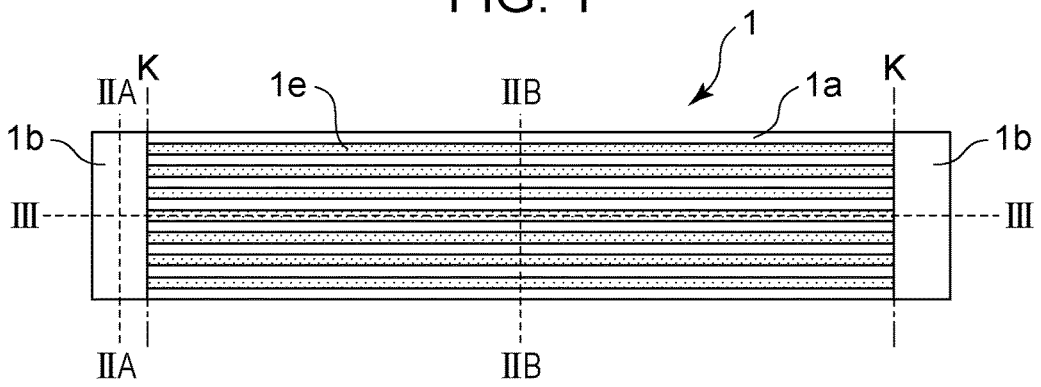
FIG. 1 is a schematic front view of a fixing film according to a first embodiment.
Figure 2A:
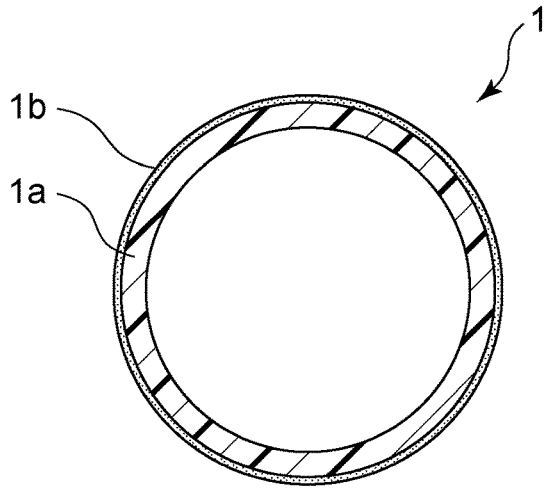
FIG. 2A is a schematic cross-sectional view of the fixing film according to the first embodiment.
Figure 2B:
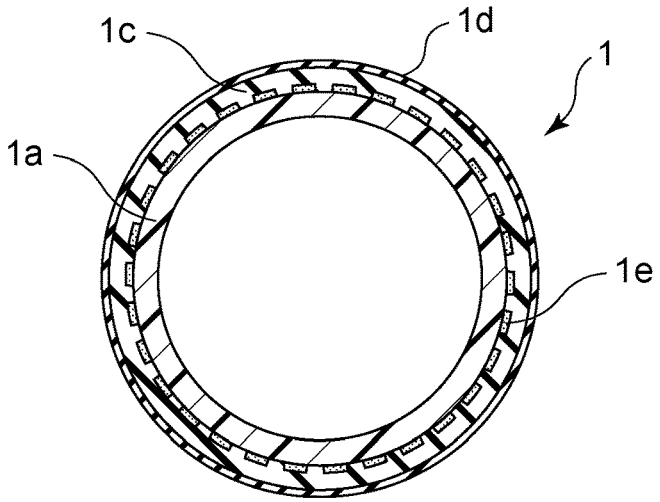
FIG. 2B is another schematic cross-sectional view of the fixing film according to the first embodiment.
Figure 3:
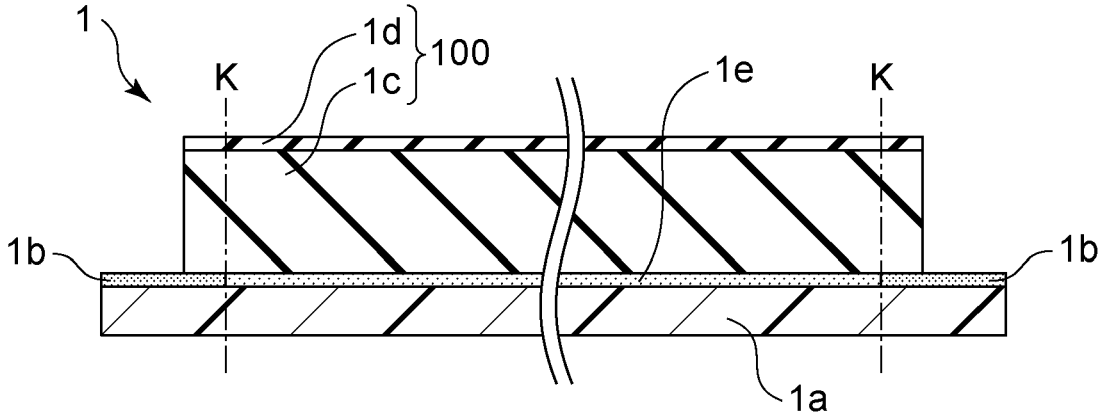
FIG. 3 is a schematic longitudinal cross-sectional view of the fixing film according to the first embodiment.

A configuration of a fixing film 1 according to the present embodiment will now be described using FIGS. 1 to 3. FIG. 1 is a schematic view for explaining the arrangement of resistive heat generating layers 1*e*, as viewed from the front of the fixing film 1. FIG. 2A is a cross-sectional view of an end portion of the fixing film 1 in the longitudinal direction, taken along line IIA-IIA of FIG. 1, and FIG. 2B is a cross-sectional view of a center portion of the fixing film 1 in the longitudinal direction, taken along line IIB-IIB of FIG. 1. FIG. 3 is a longitudinal cross-sectional view of the fixing film 1, taken along line III-III of FIG. 1.

A base layer 1*a* is a foundation layer having mechanical characteristics of the fixing film 1, such as torsional strength and smoothness. The base layer 1*a* is made of resin, such as polyimide (PI), polyamide-imide (PAI), or polyether ether ketone (PEEK).

The base layer 1*a* used in the present embodiment is a tubular polyimide layer having an outside diameter of 18 mm, a length of 240 mm in the longitudinal direction, and a thickness of 60 μm. The base layer 1*a* is an insulating layer.

The base layer 1*a* has electrode layers 1*b* formed thereon in 10-mm-long regions at both ends thereof in the longitudinal direction of the fixing film 1. The electrode layers 1*b* serve as an electrode portion for feeding power from the outer surface of the fixing film 1 to the resistive heat generating layers 1*e*. The electrode layers 1*b* are annular layers each extending in the circumferential direction of the fixing film 1. The electrode layer 1*b* is a 10-μm-thick layer of silver paste. The silver paste used to form the electrode layer 1*b* of the present embodiment has a volume resistivity of $4\times10^{-5}$ Ω·cm. This silver paste is obtained by dispersing fine silver particles in polyimide resin using a solvent. The electrode layer 1*b* is formed by applying the silver paste to the base layer 1*a* and firing the applied silver paste.

The resistive heat generating layers 1*e* form a heat generating portion. The resistive heat generating layers 1*e* are thin linear layers extending in the longitudinal direction of the fixing film 1 and spaced from one another along the circumferential direction of the fixing film 1. On the base layer 1*a*, the resistive heat generating layers 1*e* are positioned next to the electrode layers 1*b* in the longitudinal direction of the fixing film 1 and are electrically connected to the electrode layers 1*b*. The resistive heat generating layers 1*e* of the present embodiment are formed on the base layer 1*a* by screen printing using silver paste having a volume resistivity of $2\times10^{-3}$ Ω·cm. The resistive heat generating layers 1*e* measure 220 mm long, 1 mm wide, and 10 μm thick. As illustrated in FIG. 2B, 28 resistive heat generating layers 1*e* are arranged at intervals of 1 mm in the circumferential direction. Each of the 28 resistive heat generating layers 1*e* is electrically connected in parallel, at both ends thereof, to the electrode layers 1*b* at both ends of the fixing film 1. A combined resistance between the electrode layers 1*b* is 15.7Ω.

The electrode layers 1*b* are disposed at both ends of the base layer 1*a* in the longitudinal direction of the fixing film 1, and the resistive heat generating layers 1*e* are disposed in the center of the base layer 1*a* in the longitudinal direction of the fixing film 1 in such a manner that they are electrically connected to the electrode layers 1*b* at both ends thereof.

In the present embodiment, as illustrated in FIG. 3, the filmfixing film 1 includes an overcoat layer 100 composed of an elastic layer 1*c* and a mold release layer 1*d*. For convenience in explanation, the overcoat layer 100 is not shown in FIG. 1. The elastic layer 1*c* is a 170-μm-thick layer of silicone rubber containing a thermally conductive filler dispersed therein. The mold release layer 1*d* is a tetrafluoroethylene-perfluoroalkyl vinyl ether copolymer (PFA) layer of about 15 μm thick and is formed as a PFA coating on the elastic layer 1*c*. The overcoat layer 100 is 226 mm long in the longitudinal direction. The overcoat layer 100 extends 3 mm outward, at each end thereof, beyond a boundary K between the resistive heat generating layer 1*e* and the electrode layer 1*b*. That is, the overcoat layer 100 extends over the boundary K between the resistive heat generating layer 1*e* and the electrode layer 1*b* in the longitudinal direction of the fixing film 1. The elastic layer 1*c* and the mold release layer 1*d* are electrically insulated and configured to cover the resistive heat generating layers 1*e* of the fixing film 1. The elastic layer 1*c* and the mold release layer 1*d* allow the outer surfaces of the electrode layers 1*b* at both ends of the fixing film 1 to be at least partly exposed.

Although the electrode layers 1*b* and the resistive heat generating layers 1*e* are formed by printing the silver pastes in the present embodiment, the electrode layers 1*b* and the resistive heat generating layers 1*e* may be formed by other means, such as metal plating or sputtering.

Figure 4A:
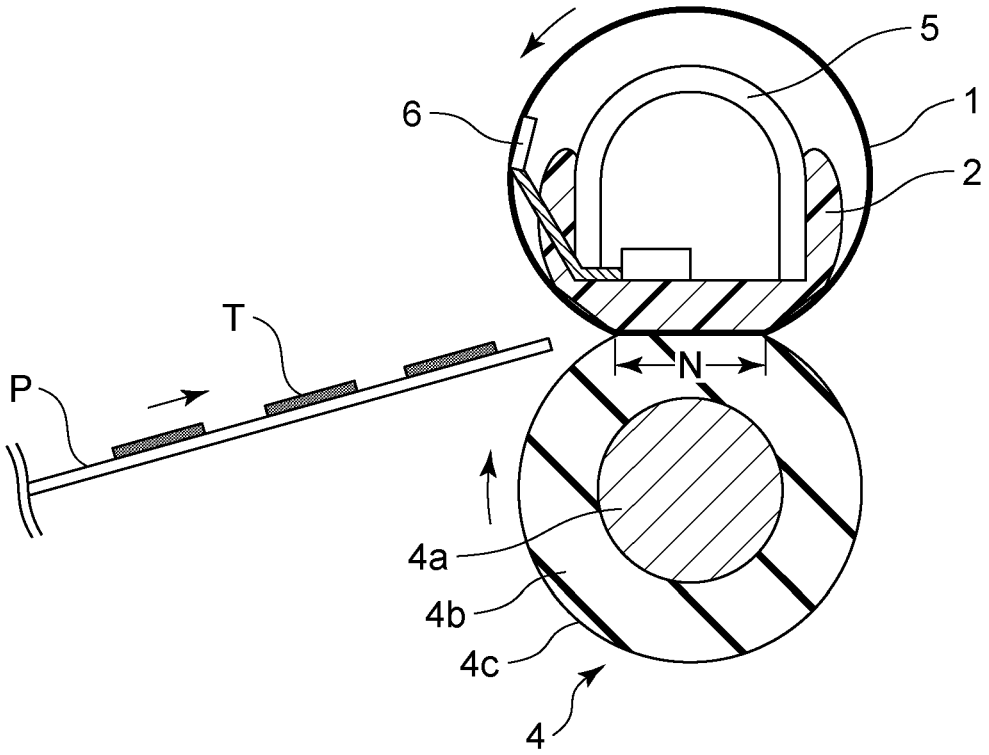
FIG. 4A is a schematic view of a fixing device according to the first embodiment.
Figure 4B:
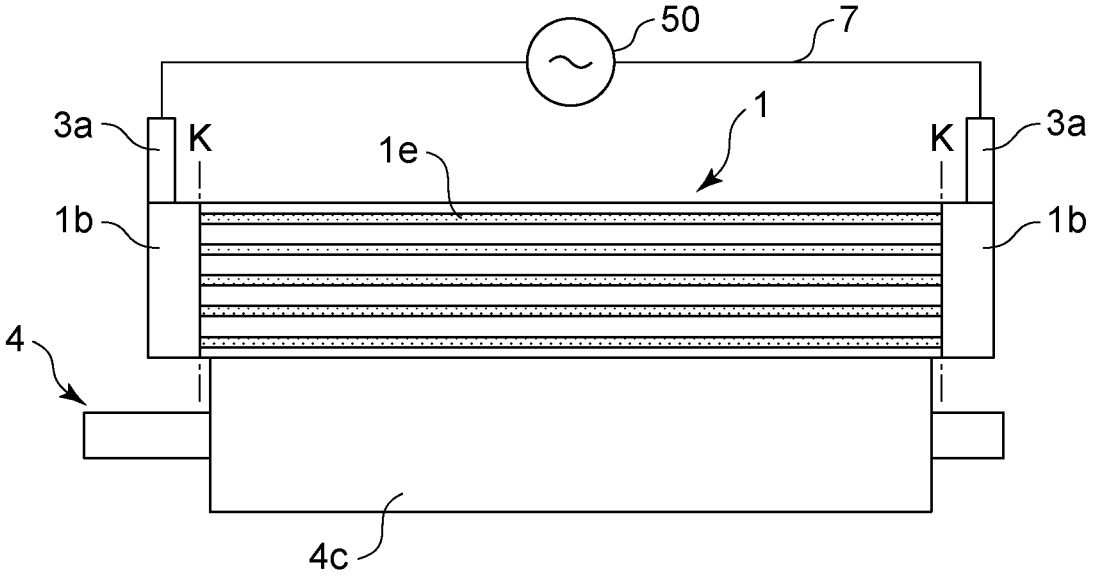
FIG. 4B is another schematic view of the fixing device according to the first embodiment.

A configuration of a fixing device according to the present embodiment will now be described with reference to FIGS. 4A and 4B. FIG. 4A is a cross-sectional view of a center portion of the fixing device in the longitudinal direction, and FIG. 4B is a schematic view of the fixing device as viewed in the direction of conveyance of a recording material. For convenience in explanation, the fixing film 1 in FIG. 4B is shown, with the elastic layer 1*c* and the mold release layer 1*d* omitted.

The fixing device is designed to heat and fix a toner image formed by an electrophotographic image forming technique on a recording material. From the left-hand side in FIG. 4A, a recording material P bearing a toner image T thereon is conveyed by a conveying means (not shown) and passed through the fixing device, by which the toner image T is heated and fixed onto the recording material P.

The fixing device of the present embodiment includes the fixing film 1 having a tubular shape and serving as a heating rotator, a film guide 2 configured to hold the fixing film 1, and a pressure roller 4 serving as a pressure member that forms a fixing nip N between itself and the fixing film 1.

The film guide 2 is made of a heat-resistant resin, such as liquid crystal polymer, polyphenylene sulfide (PPS), or PEEK. The film guide 2 is engaged with a stay 5 held by a device frame at both ends thereof in the longitudinal direction. When pressure springs (not shown) serving as pressure means apply pressure to both ends of the stay 5 in the longitudinal direction, the film guide 2 is pressed against the pressure roller 4. For the stay 5 to uniformly transmit, across the length of the film guide 2, the pressure received at both ends thereof in the longitudinal direction, the stay 5 is made of a stiff material, such as iron, stainless steel, or electro galvanized steel sheet. The stiffness of the stay 5 is enhanced by forming the stay 5 into a U shape in cross section. This enables uniform formation of the fixing nip N with a predetermined width across the length of the pressure roller 4, without causing significant warpage of the film guide 2. The film guide 2 is provided with a temperature detecting element 6, which is in contact with the inner surface of the fixing film 1. In accordance with the temperature detected by the temperature detecting element 6, a central processing unit (CPU) (not shown) controls the application of current to the fixing film 1.

In the present embodiment, liquid crystal polymer is used to form the film guide 2, and an electro galvanized steel sheet is used to form the stay 5. A pressure of 160 N is applied to the pressure roller 4, and this forms the fixing nip N of about 6 mm wide.

The pressure roller 4 includes a metal core 4*a* made of iron, aluminum, or the like, an elastic layer 4*b* made of silicone rubber or the like, and a mold release layer 4*c* made of PFA or the like. To ensure durability and form the fixing nip N having a width that ensures fixing performance, the hardness of the pressure roller 4 preferably ranges from 40° to 70° when measured with a durometer ASKER-C under a load of 9.8 N.

In the present embodiment, the pressure roller 4 is produced by forming a silicone rubber layer with a thickness of 3.5 mm onto an 11-mm-diameter iron core and covering the silicone rubber layer with an insulating PFA tube with a wall thickness of 40 μm. The pressure roller 4 has a hardness of 56° and an outside diameter of 18 mm. The elastic layer 4*b* and the mold release layer 4*c* are 218 mm long in the longitudinal direction. As illustrated in FIG. 4B, the elastic layer 4*b* (not shown) and the mold release layer 4*c* are located 1 mm inward from both ends of the resistive heat generating layers 1*e*.

Feeding members 3*a* are wired by an alternating-current (AC) cable 7 extending from an AC power supply 50. The feeding members 3*a* are in contact with the respective outer surfaces of the electrode layers 1*b* at both ends of the fixing film 1. For example, the feeding members 3*a* are leaf springs, pads, or brushes each formed by a bundle of fine gold wires.

In the present embodiment, the feeding members 3*a* are each provided as a power supply member that supplies power through the corresponding electrode layer 1*b* to the resistive heat generating layers 1*e*. The feeding member 3*a* is composed of a carbon chip and a leaf spring of stainless steel. By the biasing force of the leaf spring, the carbon chip is pressed against the exposed outer surface of the electrode layer 1*b*. By applying an AC voltage from the AC power supply 50 through the AC cable 7, power is fed to the resistive heat generating layers 1*e* of the fixing film 1 through the feeding members 3*a*.

In the present embodiment, where the fixing film 1 includes the electrode layers 1*b* at both ends of the base layer 1*a*, power can be constantly fed to the resistive heat generating layers 1*e* even during rotation of the fixing film 1. Since current from each feeding member 3*a* passes through the corresponding electrode layer 1*b* and flows into the resistive heat generating layers 1*e* uniformly in the circumferential direction, all the resistive heat generating layers 1*e* having the same volume resistivity uniformly generate heat.

Then, by a rotational force transmitted from a drive mechanism (not shown) to a drive gear (not shown) of the pressure roller 4, the pressure roller 4 is rotationally driven at a predetermined speed in the clockwise direction in FIG. 4A. As the pressure roller 4 is rotationally driven, the resulting force of friction between the pressure roller 4 and the fixing film 1 at the fixing nip N causes a rotational force to act on the fixing film 1. Thus, as the pressure roller 4 rotates, the fixing film 1 slides around the film guide 2 counterclockwise, with the inner surface of the fixing film 1 being firmly in contact with the film guide 2.

By the rotation of the pressure roller 4, the fixing film 1 is rotated, energized, heated to a predetermined temperature, and started to be temperature-controlled by the temperature detecting element 6. Then, the recording material P bearing the toner image T in an unfixed state thereon is introduced into the fixing nip N, through which the surface of the recording material P bearing the toner image T thereon is conveyed while being sandwiched between the fixing film 1 and the pressure roller 4. In this process of conveyance, the recording material P is heated by the heat of the fixing film 1. By being subjected to heat and pressure, the unfixed toner image T on the recording material P is fused and fixed onto the recording material P. After passing through the fixing nip N, the recording material P is self-stripped off the surface of the fixing film 1, discharged, and conveyed by a discharge roller pair (not shown).

Figure 5:
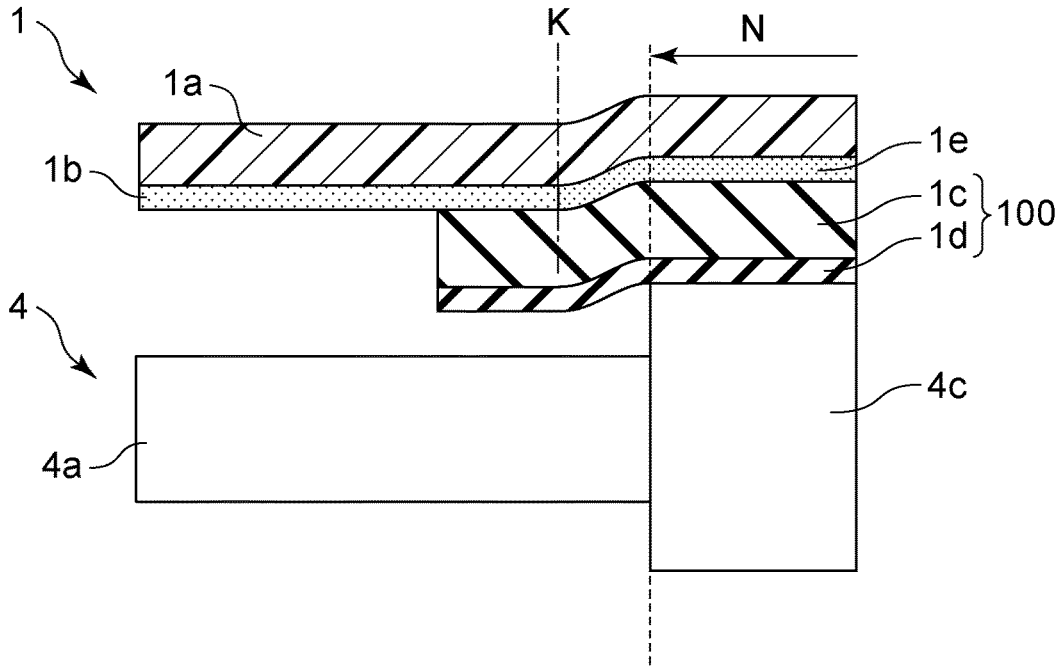
FIG. 5 is an enlarged view of an end portion of the fixing device in the longitudinal direction, according to the first embodiment.

FIG. 5 is an enlarged view of end portions of the fixing film 1 and the pressure roller 4 in the longitudinal direction. The fixing nip N extends to the end position of the elastic layer 4*b* (not shown) and the mold release layer 4*c* of the pressure roller 4. As illustrated in FIG. 4A, the fixing film 1 deforms into a flat shape at the fixing nip N and returns to the original tubular shape outside the fixing nip N. Therefore, as in FIG. 5, when viewed in the direction of conveyance of the recording material P, the fixing film 1 is bent at the end of the fixing nip N. The bend causes mechanical stress to be produced in the fixing film 1. The fixing film 1 moves as the pressure roller 4 rotates within the fixing nip N. However, at each end of the fixing film 1, the contact between the feeding member 3*a* and the electrode layer 1*b* hinders the movement of the fixing film 1. This causes torsional mechanical stress to be produced in the fixing film 1.

Accordingly, the present embodiment aims to prevent such mechanical stress from damaging the resistive heat generating layers 1*e* that are formed as a thin linear pattern on the base layer 1*a* of the fixing film 1. Specifically, in the present embodiment, forming the overcoat layer 100 over the resistive heat generating layers 1*e* can reduce the amount of bend of the resistive heat generating layers 1*e* at the end of the fixing nip N. Moreover, since the overcoat layer 100 is formed to extend over the boundary K between each electrode layer 1*b* and the resistive heat generating layers 1*e*, the torsional mechanical stress applied to the resistive heat generating layers 1*e* outside the fixing nip N can be relieved.

To confirm the advantageous effect of the present embodiment, a test was performed to observe how the fixing film 1 generated heat. In the test, the controlled temperature of the fixing film 1 was kept at 200° C., the rotational speed of the pressure roller 4 was set at 150 mm/s, and the fixing device continued to run idle without passing any sheet (recording material P) therethrough. It was confirmed by the test that even after rotation of the fixing film 1 for 250 hours, there was no occurrence of abnormal heating of the resistive heat generating layers 1*e* and the fixing film 1 continued to uniformly generate heat without stoppage of heat generation caused by breakage of the resistive heat generating layers 1*e*.

Figure 6:
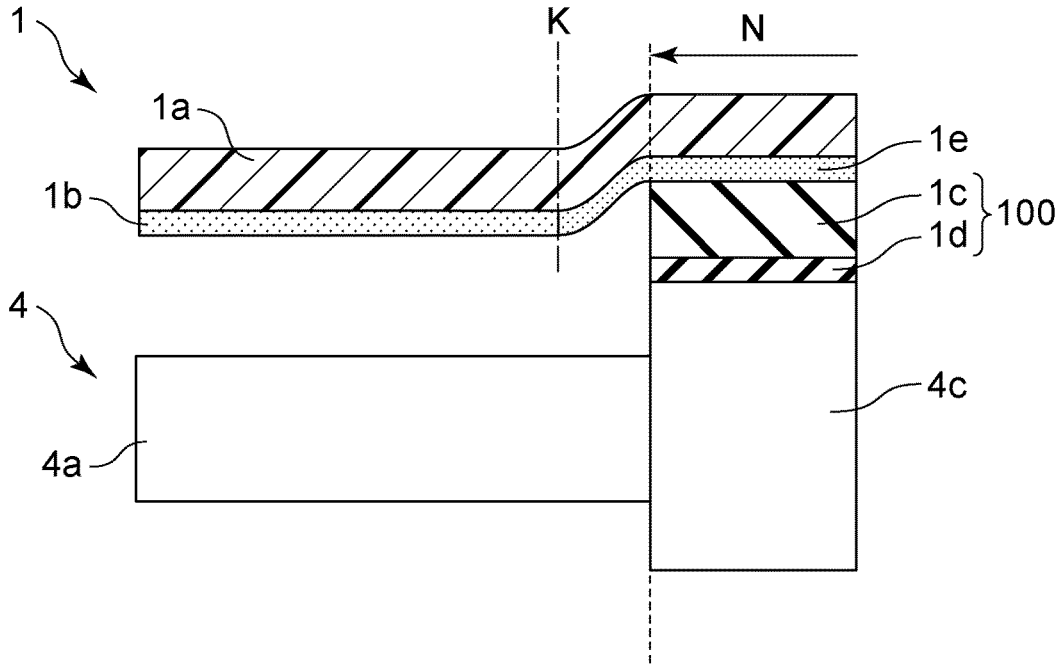
FIG. 6 is an enlarged view of an end portion of a fixing device in a longitudinal direction, according to a comparative example.

To explain the advantageous effect of the present embodiment, the same test as that for the present embodiment was performed for a comparative example. The configuration of the fixing film 1 according to the comparative example will be described with reference to FIG. 6. FIG. 6 is an enlarged view of end portions of the fixing film 1 and the pressure roller 4 in the longitudinal direction. As illustrated, the comparative example differs from the present embodiment in that the overcoat layer 100 does not extend over the boundary K between the resistive heat generating layer 1*e* and the electrode layer 1*b*. The length of the overcoat layer 100 is 218 mm, which is 8 mm shorter than that in the first embodiment. At both ends of the fixing film 1 in the longitudinal direction, the overcoat layer 100 is located 1 mm inward from the boundary K between the resistive heat generating layer 1*e* and the electrode layer 1*b*. The other configurations are the same as those in the first embodiment.

Except for the fixing film 1, the configuration of the fixing device of the comparative example is the same as that of the fixing device of the first embodiment. The elastic layer 4*b* and the mold release layer 4*c* of the pressure roller 4 are 218 mm long in the longitudinal direction. As in FIG. 6, the elastic layer 4*b* (not shown) and the mold release layer 4*c* are equal in length to the overcoat layer 100 of the fixing film 1 and are aligned therewith at both ends thereof in the longitudinal direction.

In the comparative example, as illustrated in FIG. 6, the fixing film 1 is bent at the end of the fixing nip N as in the first embodiment. However, the amount of bend of the fixing film 1 in the vicinity of the end of the fixing nip N was larger than that in the present embodiment. It was also found that the torsional mechanical stress applied to the resistive heat generating layers 1*e* outside the fixing nip N was larger than that in the present embodiment.

For the comparative example, a test was performed to observe how the fixing film 1 generated heat. Again, the controlled temperature of the fixing film 1 was kept at 200° C., the rotational speed of the pressure roller 4 was set at 150 mm/s, and the fixing device continued to run idle without passing any sheet (recording material P) therethrough. After 15 hours, the resistive heat generating layers 1*e* partly began to crack and the resulting increase in resistance at the cracks and abnormal heating were observed. After the continuous endurance test for 20 hours, part of the resistive heat generating layers 1*e* completely broke and stopped generating heat. Then after 30 hours, all the resistive heat generating layers 1*e* completely broke and heat generation in the entire fixing film 1 stopped.

The tests performed for comparison, as described above, reveal that the connecting portions between each electrode layer 1*b* and the resistive heat generating layers 1*e* of the fixing film 1 according to the present embodiment are more resistant to damage than those of the fixing film 1 according to the comparative example.

The present embodiment can thus provide a fixing film in which the connecting portion between the electrode portion and the heat generating portion is resistant to damage.

In the present embodiment, where the electrode layers 1*b* have a volume resistivity lower than the resistive heat generating layers 1*e*, the electrode layers 1*b* are made of a material different from that for the resistive heat generating layers 1*e*. This is to make the amount of heat generation in the electrode layers 1*b* smaller than that in the resistive heat generating layers 1*e*, because the electrode layers 1*b* are located outside the region through which the recording material P passes. However, the configuration is not limited to this. That is, the electrode layers 1*b* and the resistive heat generating layers 1*e* may be made of the same material. For example, the resistive heat generating layers 1*e* and the electrode layers 1*b* may be simultaneously formed as a continuous layer by screen printing over the base layer 1*a*.

Although the heat generating portion of the present embodiment is formed by a plurality of thin linear layers extending in the longitudinal direction of the fixing film, the configuration is not limited to this. The heat generating portion may have any configuration as long as the total length of all the thin linear layers forming the heat generating portion is 1/10 to 3/4 of the entire length of the base layer in the circumferential direction of the fixing film.

Second Embodiment

Figure 7:
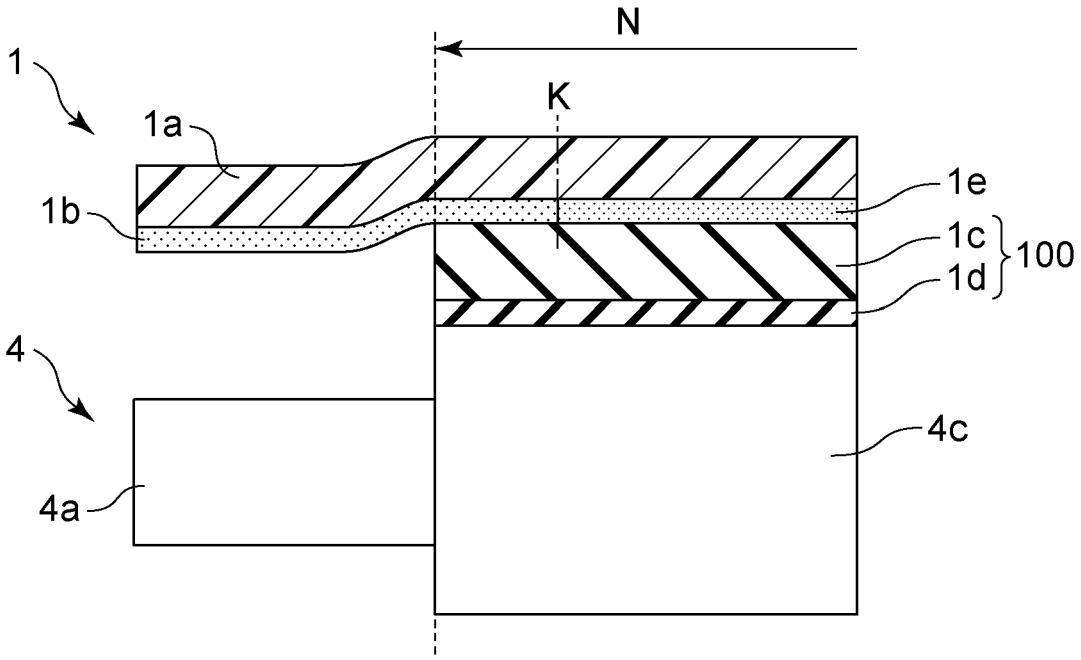
FIG. 7 is an enlarged view of an end portion of a fixing device in a longitudinal direction, according to a second embodiment.

A second embodiment will now be described with reference to FIG. 7. FIG. 7 is an enlarged view of end portions of the fixing film 1 and the pressure roller 4 in the longitudinal direction. In the present embodiment, the elastic layer 4*b* (not shown) and the mold release layer 4*c* of the pressure roller 4 are longer in the longitudinal direction than those in the first embodiment. This allows the fixing nip N to extend outward beyond the boundary K between each electrode layer 1*b* and the resistive heat generating layers 1*e*. As a result, since the region where mechanical stress develops is shifted from the resistive heat generating layers 1*e* to the electrode layers 1*b*, the risk of breakage of the resistive heat generating layers 1*e* can be reduced.

The configuration of the fixing film 1 of the present embodiment is the same as that of the fixing film 1 of the first embodiment. In the present embodiment, the elastic layer 4*b* and the mold release layer 4*c* of the pressure roller 4 are 226 mm long in the longitudinal direction. The elastic layer 4*b* and the mold release layer 4*c* are equal in length to the overcoat layer 100 of the fixing film 1 and are aligned therewith at both ends in the longitudinal direction. The other configurations are the same as those of the first embodiment.

As illustrated in FIG. 7, the elastic layer 4*b* (not shown) and the mold release layer 4*c* of the pressure roller 4 are longer in the longitudinal direction than those in the first embodiment. This allows the end portion of the fixing nip N to extend outward beyond the boundary K between each electrode layer 1*b* and the resistive heat generating layers 1*e*. Therefore, even though the fixing film 1 is bent at the end of the fixing nip N as in the first embodiment, the bend is located in the electrode layer 1*b* unlike in the first embodiment. Since mechanical stress caused by the bend and the torsional mechanical stress are produced in the electrode layer 1*b*, it is possible to reduce load on the resistive heat generating layers 1*e*. By a test performed under the same conditions as in the first embodiment, it was also confirmed that even after rotation for 250 hours as in the first embodiment, there was no occurrence of abnormalities, such as abnormal heating of the resistive heat generating layers 1*e* and stoppage of heat generation. Thus, with the configuration of the present embodiment, the same endurance test as that performed for the first embodiment was passed. Moreover, since mechanical stress is applied to the electrode layers 1*b* (solid patterns) having a high strength in the present embodiment, mechanical stress applied to the resistive heat generating layers 1*e* can be relieved more effectively than in the first embodiment.

Third Embodiment

A third embodiment will now be described with reference to FIGS. 8A to 8D. FIGS. 8A to 8D are enlarged views each illustrating end portions of the fixing film 1 and the pressure roller 4 in the longitudinal direction. The present embodiment provides four different configurations in which an additional electrode layer 1*f* is formed on the surface of each electrode layer 1*b* over the entire circumference of the fixing film 1.

Figure 8A:
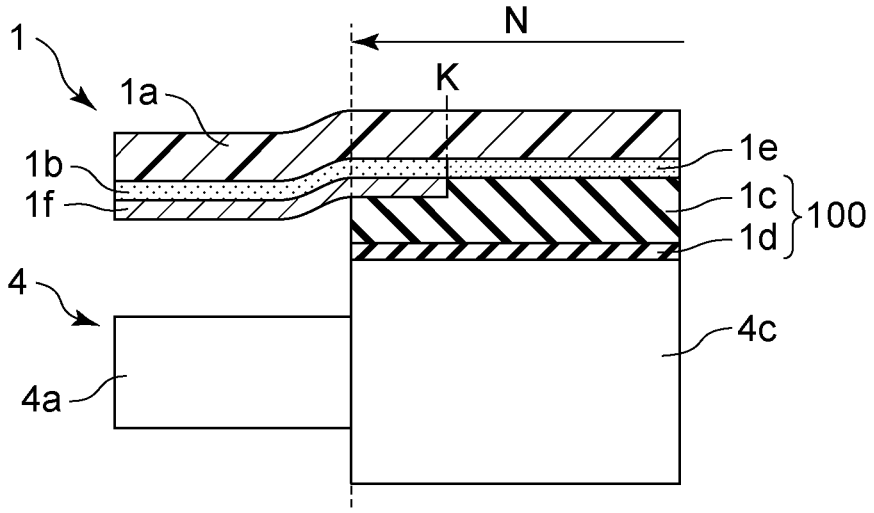
FIG. 8A is an enlarged view of an end portion of a fixing device in a longitudinal direction, according to a third embodiment.

FIG. 8A illustrates a configuration in which the resistive heat generating layers 1*e* measuring 220 mm long and the electrode layers 1*b* measuring 10 mm long at both ends are formed on the surface of the base layer 1*a* as in the first embodiment, and the electrode layer 1*f* measuring 10 mm long is additionally formed on the surface of each electrode layer 1*b*. A position (indicated by a dotted line K) where the resistive heat generating layer 1*e* and the electrode layer 1*b* are in contact is the boundary K which is, in the longitudinal direction of the fixing film 1, the innermost position where the resistive heat generating layer and the electrode layer are in contact.

Figure 8B:
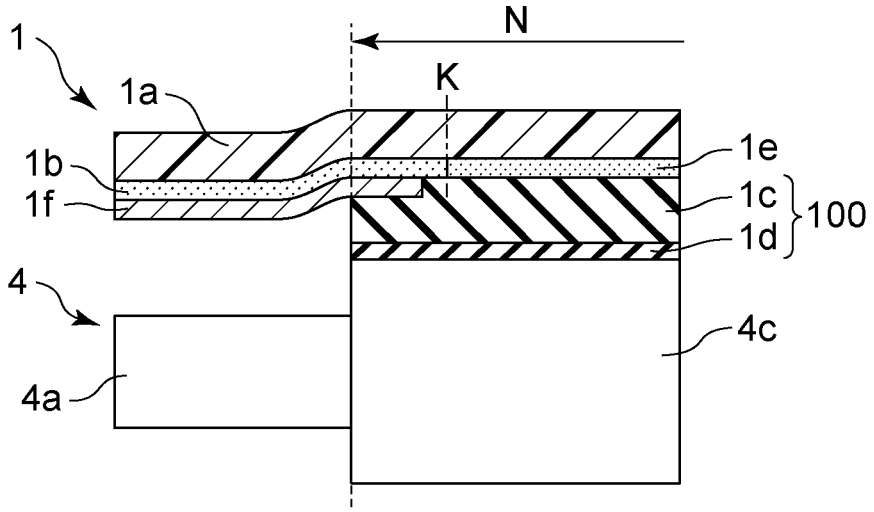
FIG. 8B is an enlarged view of a modified end portion of the fixing device in the longitudinal direction, according to the third embodiment.

FIG. 8B illustrates a configuration in which the resistive heat generating layers 1*e* measuring 220 mm long and the electrode layers 1*b* measuring 10 mm long at both ends are formed on the surface of the base layer 1*a* as in the first embodiment, and the electrode layer 1*f* measuring 9 mm long is additionally formed on the surface of each electrode layer 1*b*. Again, a position (indicated by a dotted line K) where the resistive heat generating layer 1*e* and the electrode layer 1*b* are in contact is the boundary K which is, in the longitudinal direction of the fixing film 1, the innermost position where the resistive heat generating layer and the electrode layer are in contact.

Figure 8C:
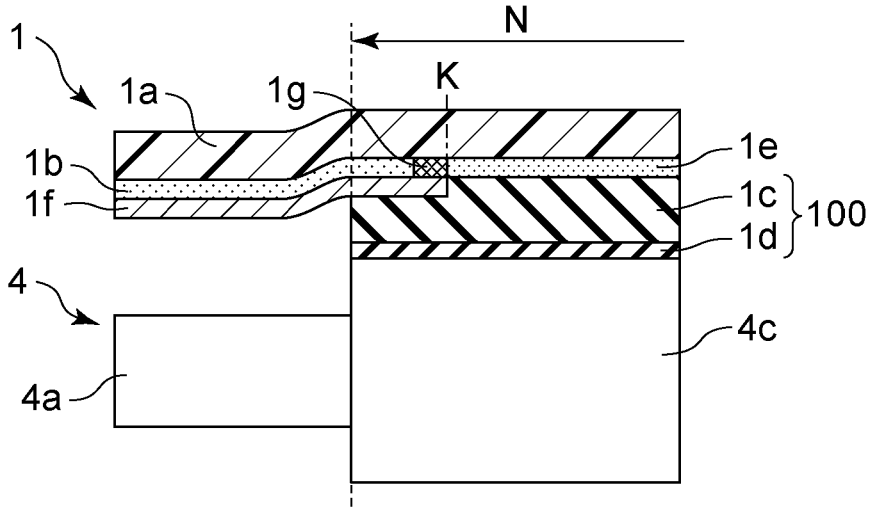
FIG. 8C is an enlarged view of another modified end portion of the fixing device in the longitudinal direction, according to the third embodiment.

FIG. 8C illustrates a configuration in which the resistive heat generating layers 1*e* measuring 222 mm long and the electrode layers 1*b* measuring 9 mm long at both ends are formed on the surface of the base layer 1*a*, and the electrode layer 1*f* measuring 10 mm long is additionally formed on each electrode layer 1*b* and the surfaces of portions (1 mm long, each indicated by reference numeral 1*g*) of the resistive heat generating layers 1*e*. The portions 1*g* of the resistive heat generating layers 1*e* form a pattern of 1-mm-wide lines arranged at intervals of 1 mm. However, when the electrode layer 1*f* is formed by screen printing from the surfaces of the resistive heat generating layers 1*e*, silver paste (which is the material of the electrode layer 1*f*) enters the gaps in the pattern of the resistive heat generating layers 1*e*. Thus, the pattern of the resistive heat generating layers 1*e* disappears and turns into the electrode layer 1*f*, which is a solid layer. This means that a position (indicated by a dotted line K) where the resistive heat generating layer 1*e* and the electrode layer 1*f* are in contact is the boundary K which is, in the longitudinal direction of the fixing film 1, the innermost position where the resistive heat generating layer and the electrode layer are in contact. The resistive heat generating layers 1*e* are shortened to 220 mm by the length of the portions 1*g* (each 1 mm).

Figure 8D:
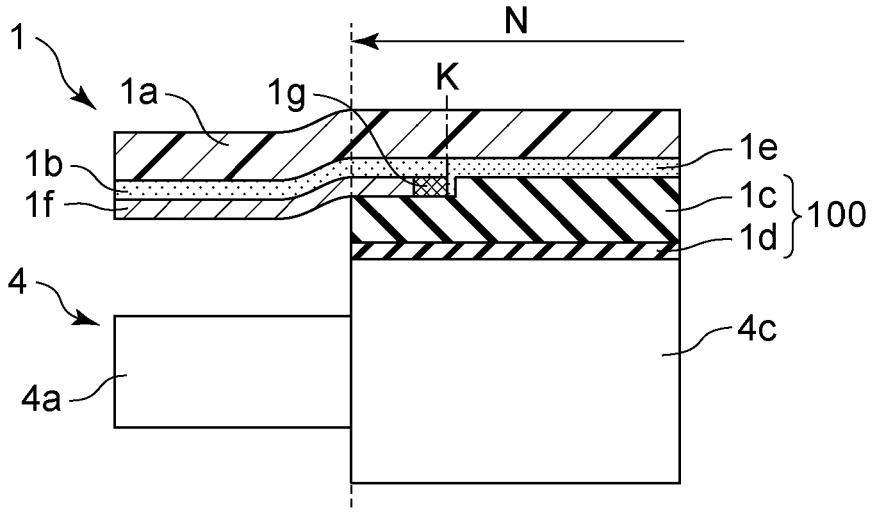
FIG. 8D is an enlarged view of another modified end portion of the fixing device in the longitudinal direction, according to the third embodiment.
Figure 9:
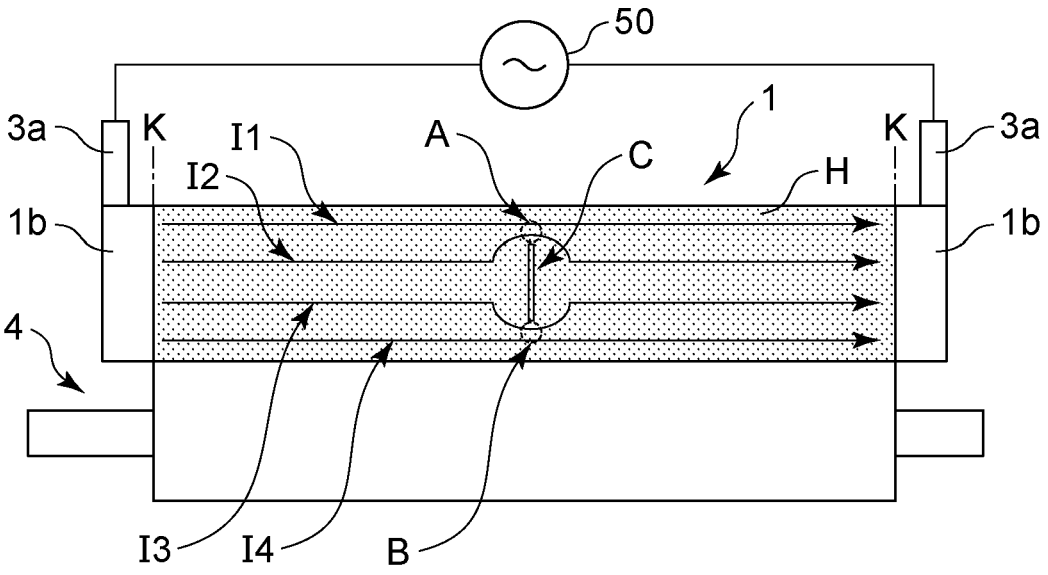
FIG. 9 illustrates a fixing device of the related art which uses a heating rotator including resistive heat generating layers.

FIG. 8D illustrates a configuration in which after the electrode layers 1*b* measuring 10 mm long are formed on the surface of the base layer 1*a*, the resistive heat generating layers 1*e* measuring 222 mm long are also formed on the surface of the base layer 1*a*, with portions thereof indicated by reference numeral 1*g* (1 mm long) each overlapping the surface of the corresponding electrode layer 1*b*. FIG. 8D also shows that the electrode layer 1*f* measuring 9 mm long is formed on the surface of each electrode layer 1*b* to connect to the portions 1*g* of the resistive heat generating layers 1*e*. A position (indicated by a dotted line K) where the resistive heat generating layer 1*e* and the electrode layer 1*b* are in contact is the boundary K which is, in the longitudinal direction of the fixing film 1, the innermost position where the resistive heat generating layer and the electrode layer are in contact. Current fed to the electrode layer 1*f* flows through the electrode layer 1*b* having a resistance lower than the portion 1*g* of the resistive heat generating layer 1*e*. Therefore, even if the portion 1*g* of the resistive heat generating layer 1*e* is broken, current can be passed from the electrode layer 1*b* to the resistive heat generating layer 1*e* through the boundary K.

In the four different configurations illustrated in FIGS. 8A to 8D, the boundary K which is, in the longitudinal direction of the fixing film 1, the innermost position where the resistive heat generating layer 1*e* is in contact with either the electrode layer 1*b* or electrode layer 1*f* is located 10 mm from each end of the fixing film 1. The overcoat layer 100 measures 226 mm long and extends 3 mm outward from the boundary K to overlap the electrode layer 1*b* and the electrode layer 1*f* at both ends of the fixing film 1 in the longitudinal direction. The electrode layer 1*f* is 10 μm thick and made of the same material as the electrode layer 1*b*. The other configurations are the same as those of the first embodiment.

As in the second embodiment, the elastic layer 4*b* and the mold release layer 4*c* of the pressure roller 4 in the present embodiment are 226 mm long in the longitudinal direction. That is, as illustrated in FIGS. 8A to 8D, the elastic layer 4*b* (not shown) and the mold release layer 4*c* are equal in length to the overcoat layer 100 of the fixing film 1 and are aligned therewith at both ends thereof in the longitudinal direction. The other configurations are the same as those of the first embodiment.

In the configurations illustrated in FIGS. 8A to 8D, the overcoat layer 100 extends outward from the boundary K, which is the innermost position where the resistive heat generating layer 1*e* is in contact with either the electrode layer 1*b* or electrode layer 1*f* in the longitudinal direction of the fixing film 1. By an endurance test performed during idle rotation as in the first embodiment, it was also confirmed that even after rotation for 250 hours, there was no occurrence of abnormalities, such as abnormal heating of the resistive heat generating layers 1*e* and stoppage of heat generation. It was thus confirmed that with the configuration of the present embodiment which includes stacked electrode layers, mechanical stress on the resistive heat generating layers 1*e* was relieved.

Although the overcoat layer 100 including the elastic layer 1*c* is used in the first, second, and third embodiments, the configuration of the overcoat layer 100 is not limited to this. That is, the overcoat layer 100 may be made of any material that has a lower Young's modulus than the base layer 1*a*. As described, the overcoat layer 100 is in contact with the electrode layers 1*b* at both ends of the fixing film 1. Therefore, to prevent current from flowing into the overcoat layer 100, the overcoat layer 100 preferably has a higher electrical resistance than the resistive heat generating layers 1*e*. The overcoat layer 100 is preferably an insulating layer. The elastic layer 1*c* of the overcoat layer 100 may be, for example, a layer of silicone rubber containing a thermally conductive filler with high electrical resistance, or an insulating thermally conductive filler, dispersed therein. Similarly, when the overcoat layer 100 is made of metal, the inner surface of the overcoat layer 100 of metal needs to be insulated to prevent a short circuit through the overcoat layer 100 between the electrodes at both ends.

For the reasons described above, it is preferable that the overcoat layer 100 include an elastic layer made of silicone rubber, such as that described in the first, second, and third embodiments. Alternatively, the overcoat layer 100 may include the mold release layer 1*d* alone.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A fixing member used for a fixing device, the fixing member comprising:

a tubular base layer;

an electrode portion formed on the base layer;

a heat generating portion formed by a plurality of thin linear layers extending in a longitudinal direction of the fixing member and spaced from one another along a circumferential direction of the fixing member, the heat generating portion being formed on the base layer in such a manner as to be positioned next to the electrode portion in the longitudinal direction of the fixing member and electrically connected to the electrode portion; and a rubber layer formed on the heat generating portion, the rubber layer being disposed to extend over a boundary between the heat generating portion and the electrode portion in the longitudinal direction of the fixing member, wherein in the circumferential direction of the fixing member, a total area on which all of the thin linear layers are provided is 1/10 to 3/4 of an entire length of the base layer.

2. The fixing member according to claim 1, wherein the electrode portion and the heat generating portion are layers that are made of the same material and form a continuous layer.

3. The fixing member according to claim 1, wherein the electrode portion has a lower volume resistivity than the heat generating portion.

4. The fixing member according to claim 1, wherein the electrode portion is disposed at an end of the base layer in the longitudinal direction of the fixing member, and the heat generating portion is disposed in a center of the base layer in the longitudinal direction of the fixing member.

5. The fixing member according to claim 1, wherein the rubber layer is an insulating layer.

6. The fixing member according to claim 1, wherein the electrode portion is an annular layer extending in the circumferential direction of the fixing member.

7. The fixing member according to claim 1, wherein the fixing member is a film.

8. The fixing member according to claim 1, wherein the rubber layer is a silicone rubber layer.

9. A fixing device that fixes an image onto a recording material, the fixing device comprising:

a fixing member including a tubular base layer, an electrode portion formed on the base layer, a heat generating portion formed by a plurality of thin linear layers extending in a longitudinal direction of the fixing member and spaced from one another along a circumferential direction of the fixing member, the heat generating portion being formed on the base layer in such a manner as to be positioned next to the electrode portion in the longitudinal direction of the fixing member and electrically connected to the electrode portion, and an rubber layer formed on the heat generating portion, the rubber layer being disposed to extend over a boundary between the heat generating portion and the electrode portion in the longitudinal direction of the fixing member, the fixing member being configured to come into contact with the image; and a power supply member configured to supply power through the electrode portion to the heat generating portion, wherein the fixing member generates heat as current flows through the heat generating portion, and a toner image is fixed onto the recording material by the heat of the fixing member, and wherein in the circumferential direction of the fixing member, a total area on which all of the thin linear layers are provided is 1/10 to 3/4 of an entire length of the base layer.

10. The fixing device according to claim 9, wherein the electrode portion and the heat generating portion are layers that are made of the same material and form a continuous layer.

11. The fixing device according to claim 9, wherein the electrode portion has a lower volume resistivity than the heat generating portion.

12. The fixing device according to claim 9, wherein the electrode portion is disposed at an end of the base layer in the longitudinal direction of the fixing member, and the heat generating portion is disposed in a center of the base layer in the longitudinal direction of the fixing member.

13. The fixing device according to claim 9, wherein the rubber layer is an insulating layer.

14. The fixing device according to claim 9, wherein the electrode portion is an annular layer extending in the circumferential direction of the fixing member.

15. The fixing device according to claim 9, wherein the fixing member is a film.

16. The fixing member according to claim 9, wherein the rubber layer is a silicone rubber layer.

* * * * *